US008780007B2

(12) United States Patent
Tseng et al.

(10) Patent No.: US 8,780,007 B2
(45) Date of Patent: Jul. 15, 2014

(54) HANDHELD DEVICE AND PLANAR ANTENNA THEREOF

(75) Inventors: Chun-Wei Tseng, Taoyuan (TW); Yen-Liang Kuo, Taoyuan (TW); Wan-Ming Chen, Taoyuan (TW)

(73) Assignee: HTC Corporation, Taoyuan (TW)

( * ) Notice: Subject to any disclaimer, the term of this patent is extended or adjusted under 35 U.S.C. 154(b) by 322 days.

(21) Appl. No.: 13/106,934

(22) Filed: May 13, 2011

(65) Prior Publication Data

US 2012/0287014 A1 Nov. 15, 2012

(51) Int. Cl.

| | |
|---|---|
| ***H01Q 3/24*** | (2006.01) |
| ***H01Q 9/04*** | (2006.01) |
| ***H01Q 5/00*** | (2006.01) |
| ***H01Q 1/24*** | (2006.01) |
| ***H01Q 9/14*** | (2006.01) |

(52) U.S. Cl.

CPC ..... *H01Q 1/243* (2013.01); *H01Q 9/0421* (2013.01); *H01Q 9/0442* (2013.01); *H01Q 5/0034* (2013.01); *H01Q 9/145* (2013.01)

USPC ..... 343/876

(58) Field of Classification Search

USPC ..... 343/876, 702

See application file for complete search history.

(56) References Cited

U.S. PATENT DOCUMENTS

| | | | | |
|---|---|---|---|---|
| 6,255,944 | B1 | 7/2001 | Addy | |
| 7,164,387 | B2 * | 1/2007 | Sievenpiper | 343/702 |
| 8,144,071 | B2 | 3/2012 | Thornell-Pers | |
| 2004/0041734 | A1 | 3/2004 | Shiotsu et al. | |
| 2007/0229381 | A1 | 10/2007 | Piisila et al. | |
| 2008/0291113 | A1 * | 11/2008 | Ou-Yang | 343/876 |
| 2009/0066584 | A1 | 3/2009 | Thornell-Pers | |
| 2012/0229346 | A1 * | 9/2012 | Chen et al. | 343/702 |

FOREIGN PATENT DOCUMENTS

| | | |
|---|---|---|
| CN | 1914765 | 2/2007 |
| EP | 1 094 542 | 4/2001 |

(Continued)

OTHER PUBLICATIONS

Search Report from corresponding EPO Application No. 1256782.0 dated May 31, 2012.

(Continued)

*Primary Examiner* — Seung Lee

(74) *Attorney, Agent, or Firm* — Grossman, Tucker, Perreault & Pfleger, PLLC

(57) ABSTRACT

A handheld device and a planar antenna thereof are provided. The planar antenna comprises a radiator, a screening element and a switch. The screening element is configured to make the planar antenna operating in a first high-frequency (HF) current path and a first low-frequency (LF) current path, and the switch is configured to make the planar antenna operating in a second HF current path and a second LF current path. The planar antenna operates at a first HF central frequency corresponding to the first HF current path and a first LF central frequency corresponding to the first LF current path when the switch is turned off, and operates at a second HF central frequency corresponding to the second HF current path and a second LF central frequency corresponding to the second LF current path when the switch is turned on.

12 Claims, 7 Drawing Sheets

(56) References Cited

FOREIGN PATENT DOCUMENTS

| | | |
|---|---|---|
| EP | 1 548 877 | 6/2005 |
| EP | 1 699 108 | 9/2006 |
| JP | 11-251825 | 9/1999 |
| JP | 2000-114856 | 4/2000 |
| JP | 2000-236209 | 8/2000 |
| JP | 2009-538037 | 10/2009 |
| JP | 2009-290522 | 12/2009 |
| WO | 99/03168 | 1/1999 |
| WO | 2005074070 | 8/2005 |

OTHER PUBLICATIONS

Extended European Search Report dated Jul. 31, 2012 issued in European Patent Application No. 12156782.0, 12 pages.
Office Action from related Japanese Appln. No. 2011-179155 dated Dec. 17, 2013. English translation attached.
Office Action from related Japanese Appln. No. 2011-179155 dated Jul. 23, 2013. English translation attached.
Office Action from related Chinese Appln. No. 20110266579.2 dated Jan. 3, 2014. English translation attached.
Office Action from related Japanee Appln. No. 2011-179155 dated Apr. 28, 2014. English Translation attached.

* cited by examiner

HANDHELD DEVICE AND PLANAR ANTENNA THEREOF

REPRESENTATIVE FIGURE (i) Representative Figure: FIG. 1

(ii) Brief description of reference numerals of the representative figure:

1: handheld device
11: substrate
111: clearance area
113: circuit board
13: planar antenna
131: radiator
133: screening element
135: switch
137: carrier

CHEMICAL FORMULA BEST CHARACTERIZING THE INVENTION

None

DESCRIPTION OF THE INVENTION

1. Field of the Invention

The subject application relates to a handheld device and a planar antenna thereof. More particularly, the planar antenna of the subject application comprises a screening element configured to make the planar antenna operating at two central frequencies and a switch configured to make the planar antenna operating at another two central frequencies.

2. Descriptions of the Related Art

As modern people's demands on the wireless communication become increasingly higher, handheld devices (e.g., mobile phones, notebook computers, tablet personal computers and wireless network routers) have gradually become indispensable to modern people's life. In order to meet the demands of modern people on the handheld devices, handheld device manufacturers all try to design the handheld devices to be more humanized or more adapted for people's needs. Among these designs, multi-frequency operability and a slim profile are most desired by the modern people.

In order to impart the handheld devices with the multi-frequency operability, the manufacturers have made great efforts to develop antennas with the multi-frequency operability in the recent years. Among these antennas, a planar inverted-F antenna (PIFA) with a slim profile has received the most attention. The conventional single-frequency planar inverted-F antenna has only a radiator of about ¼ wavelength as a resonant current path. If the single-frequency planar inverted-F antenna is to operate at more central frequencies, then other parasitic antenna elements and/or other branches must be added to form multiple current paths. In other words, if a common conventional antenna needs to transmit and receive two or more kinds of signals, it must have two or more radiator branches that transmit and receive signals at respective operating frequencies; however, as these radiators occupy much space and, meanwhile, the handheld devices for the antenna does not have a large enough clearance area, the transceiving quality of the antenna is degraded.

In design of the conventional multi-frequency planar inverted-F antennas, due to the increased number of antenna elements, an unexpected coupling effect may be generated between the antenna elements to increase the complexity in design of the antennas; meanwhile, also due to the increased number of the antenna elements, the overall volume of the antenna is increased and this results in various disadvantages. Furthermore, the conventional multi-frequency planar inverted-F antennas cannot be switched flexibly to operate at multiple central frequencies.

In view of this, an urgent need exists in the art to design a planar antenna, which has a small volume, a simple design and a capability of flexibly operating at multiple central frequencies.

CONTENTS OF THE INVENTION

An objective of the subject application is to provide a planar antenna, which has a small volume, a simple design and a capability of flexibly operating at multiple central frequencies. The planar antenna of the subject application has only one radiator, so it has a reduced volume compared to the conventional multi-frequency planar inverted-F antennas. In addition, as the planar antenna of the subject application can operate at multiple central frequencies without need of other parasitic antenna elements and/or other branches, the complexity in design of the planar antenna is also reduced.

To achieve the aforesaid objective, the subject application discloses a planar antenna, which comprises a radiator, a screening element and a switch. The radiator comprises: a first portion comprising a first contact point and a second contact point; a second portion comprising a third contact point, a fourth contact point electrically connected to the second contact point, and a fifth contact point; and a third portion comprising a sixth contact point. The screening element is electrically connected between the fifth contact point and the sixth contact point to make the planar antenna operating at a first high-frequency (HF) current path and a first low-frequency (LF) current path. The switch is electrically connected between the first contact point and the third contact point to make the planar antenna operating at a second HF current path and a second LF current path. When the switch is turned off, the planar antenna operates at a first HF central frequency corresponding to the first HF current path and a first LF central frequency corresponding to the first LF current path. When the switch is turned on, the planar antenna operates at a second HF central frequency corresponding to the second HF current path and a second LF central frequency corresponding to the second LF current path.

Another objective of the subject application is to provide a handheld device and a planar antenna thereof. The planar antenna is disposed within a clearance area of a substrate of the handheld device. Compared to the conventional multi-frequency planar inverted-F antennas, the planar antenna of the subject application has a reduced volume, so it can be disposed within the clearance area more effectively and the clearance area can be completely utilized to improve the communication quality of the handheld device. Accordingly, in case that the size of the clearance area is not reduced with the volume of the planar antenna, the subject application can reduce the influence of electronic elements, which are disposed outside the clearance area, on the planar antenna so as to improve the communication quality of the handheld device. On the other hand, in case that the size of the clearance area is reduced with the volume of the planar antenna, the subject application can make the internal spatial arrangement of the handheld device more flexible and minimize the influence of the electronic elements on the planar antenna so as to maintain the communication quality of the handheld device.

To achieve the aforesaid objective, the subject application further discloses a handheld device, which comprises a substrate and a planar antenna. The substrate includes a clearance area, and the planar antenna is disposed within the clearance area and configured to transmit and receive an RF signal. The planar antenna comprises a radiator, a screening element and a switch. The radiator comprises: a first portion comprising a first contact point and a second contact point; a second portion comprising a third contact point, a fourth contact point electrically connected to the second contact point, and a fifth contact point; and a third portion comprising a sixth contact point. The screening element is electrically connected between the fifth contact point and the sixth contact point to make the planar antenna operating in a first HF current path and a first LF current path. The switch is electrically connected between the first contact point and the third contact point to make the planar antenna operating in a second HF current path and a second LF current path. When the switch is turned off, the planar antenna operates at a first HF central frequency corresponding to the first HF current path and a first LF central frequency corresponding to the first LF current path. When the switch is turned on, the planar antenna operates at a second HF central frequency corresponding to the second HF current path and a second LF central frequency corresponding to the second LF current path. The detailed technology and preferred embodiments implemented for the present invention are described in the following paragraphs accompanying the appended drawings for people skilled in this field to well appreciate the features of the claimed invention.

DESCRIPTION OF THE PREFERRED EMBODIMENT

The present invention mainly relates to a handheld device and a planar antenna thereof, and the planar antenna has a small volume, a simple design and a capability of flexibly operating at multiple central frequencies. The following embodiments are only for purpose of illustrating the present invention rather than to limit the scope of the present invention. It shall be appreciated that, in the following embodiments and the attached drawings, elements unrelated to the present invention are omitted from depiction. Furthermore, dimensional relationships among individual elements in the attached drawings are illustrated only for ease of understanding but not to limit the actual scale.

A first embodiment of the present invention is shown in FIG. 1 and FIG. 2. Specifically, FIG. 1 is a schematic view of a handheld device 1 of the present invention, and FIG. 2 is a top view of a planar antenna 13 for the handheld device 1.

As shown in FIG. 1, the handheld device 1 comprises a substrate 11 and a planar antenna 13. It shall be noted that, for purpose of simplicity, other elements of the handheld device 1 such as a touch display module, a communication module, an input module, a power supply module and related necessary elements are all omitted from depiction. The substrate 11 comprises a clearance area 111 and a circuit board 113, and the planar antenna 13 comprises a radiator 131, a screening element 133, a switch 135 and a carrier 137. The substrate 11 can be generally considered as a system ground plane of the handheld device 1, the radiator 131 is arranged on the carrier 137, and the planar antenna 13 is disposed within the clearance area 111 of the handheld device 1 and configured to transmit and receive a radio frequency (RF) signal.

Further speaking, as shown in FIG. 2, the radiator 131 comprises a first portion 1311, a second portion 1313 and a third portion 1315. The first portion 1311 comprises a first contact point 1311*a* and a second contact point 1311*b*; the second portion 1313 comprises a third contact point 1313*a*, a fourth contact point 1313*b* and a fifth contact point 1313*c*; and the third portion 1315 comprises a sixth contact point 1315*a*. In this embodiment, the second contact point 1311*b* of the first portion 1311 is electrically connected to the fourth contact point 1313*b* of the second portion 1313 directly; i.e., the first portion 1311 of the radiator 131 is physically joined to the second portion 1313 directly.

The screening element 133 is electrically connected between the fifth contact point 1313*c* and the sixth contact point 1315*a* so that the planar antenna 13 has a first high-frequency (HF) current path and a first low-frequency (LF) current path. Specifically, when the planar antenna operates in a first frequency band operating mode, the screening element 133 excludes the third portion 1315 from the first HF current path (i.e., the fifth contact point 1313*c* and the sixth contact point 1315*a* form an open circuit therebetween), and incorporates the third portion 1315 into the first LF current path (i.e., the fifth contact point 1313*c* and the sixth contact point 1315*a* form a short circuit therebetween). In other words, the screening element 133 allows the radiator 131 of the planar antenna to operate in a dual operating modes, i.e., to resonate at two primary central frequencies (e.g., one fundamental frequency and at least one harmonic frequency) simultaneously.

The switch 135 is electrically connected between the first contact point 1311*a* and the third contact point 1313*a* so that the planar antenna 13 has a second HF current path and a second LF current path. Specifically, when the switch 135 is turned on (i.e., the first contact point 1311*a* and the third contact point 1313*a* are electrically conducted to each other), the planar antenna operates in a second frequency band operating mode; and in this case, the second HF current path includes the conductor between the first contact point 1311*a* and the third contact point 1313*a* but excludes the third portion 1315; and the second LF current path includes both the conductor between the first contact point 1311*a* and the third contact point 1313*a* and the third portion 1315. Accordingly, in the precondition that the screening element 133 can make the radiator 131 of the planar antenna resonating at two primary central frequencies simultaneously, the switch 135 can further make the radiator 131 of the planar antenna resonating at another two primary central frequencies. It shall be appreciated that, the switch 135 may be a mechanical switch, an electronic switch or any other element configured to control conducting between the first contact point 1311*a* and the third contact point 1313*a*.

Furthermore, the first portion 1311 of the radiator 131 further comprises a feeding point 1317 electrically connected to a signal terminal (not shown) of the circuit board 113, and the second portion 1313 of the radiator 131 further comprises a ground point 1319 electrically connected to a ground terminal (not shown) of the circuit board 113; thus, the handheld device 1 can transmit and receive the RF signal via the planar antenna 13. Further speaking, when the switch 135 is turned off, the planar antenna 13 operates in the first frequency band operating mode (i.e., at a first HF central frequency corresponding to the first HF current path and a first LF central frequency corresponding to the first LF current path); and when the switch 135 is turned on, the planar antenna 13 operates in the second frequency band operating mode (i.e., at a second HF central frequency corresponding to the second HF current path and a second LF central frequency corresponding to the second LF current path).

FIG. 3 depicts the planar antenna 13 according to a second embodiment of the present invention. In this embodiment, the screening element 133 consists of an inductor and a capacitor. In other words, the screening element 133 is comprised of at least one passive element, and is coupled between the fifth contact point 1313*c* of the second portion 1313 and the sixth contact point 1315*a* of the third portion 1315 of the radiator 131. It shall be appreciated that, in other embodiments, the screening element 133 may be a single inductor, or may be replaced with an elongate transmission line or any other element or combination of elements having impedance characteristics. The so-called combination may be comprised of a single kind of elements or multiple kinds of elements. Therefore, according to the disclosures of the embodiments of the present invention, those of ordinary skill in the art can readily replace the screening element 133 with other elements to achieve the same efficacy.

FIG. 4 depicts the planar antenna 13 according to a third embodiment of the present invention. As shown in FIG. 4, the switch 135 of the planar antenna 33 is a diode element. The diode element has an anode terminal coupled to the first contact point 1311*a* of the first portion 1311 of the radiator 131, and a cathode terminal coupled to the third contact point 1313*a* of the second portion 1313 of the radiator 131.

Furthermore, the planar antenna 13 further comprises an RF choke 139, which is electrically connected between the feeding point 1317 of the first portion 1311 of the radiator 131 and a direct current (DC) output terminal of the circuit board 113 to block an RF signal flowing into the DC output terminal. In this embodiment, whether the diode element is turned on or off is controlled by a DC control signal outputted from the DC output terminal. On the other hand, the planar antenna 33 further comprises a DC blocker 141. The DC blocker 141 is a capacitor, which is electrically connected between the second contact point 1311*b* of the first portion 1311 of the radiator 131 and the fourth contact point 1313*b* of the second portion 1313 of the radiator 131 and configured to block the DC control signal flowing into the fourth contact point 1313*b* of the second portion 1313 via the second contact point 1311*b* of the first portion 1311. It shall be appreciated that, in other embodiments, the DC blocker 141 may be any other element or combination of elements that can block a DC current from passing therethrough, but is not limited to the capacitor.

Further speaking, when a voltage at the DC output terminal is lower than a preset value (threshold), the diode element is turned off (i.e., un-conducting), so an open circuit is formed between the first contact point 1311*a* of the first portion 1311 and the third contact point 1313*a* of the second portion 1313 of the radiator 131. In this case, the planar antenna 33 operates in the first frequency band operating mode. However, when the voltage at the DC output terminal is higher than the preset value, the diode element is turned on, so a current path is formed between the first contact point 1311*a* of the first portion 1311 and the third contact point 1313*a* of the second portion 1313 of the radiator 131. In this case, the planar antenna 33 operates in the second frequency band operating mode.

FIG. 5 depicts the planar antenna 13 according to a fourth embodiment of the present invention. Different from the third embodiment, in the fourth embodiment, the feeding point 1317 of the planar antenna 13 is located in the second portion 1313 of the radiator 131, and the ground point 1319 of the planar antenna 13 is located in the first portion 1311 of the radiator 131. The switch 135 of the planar antenna 13 is also a diode element; however, the cathode terminal of the diode element is coupled to the first contact point 1311*a* of the first portion 1311 of the radiator 131, and the anode terminal of the diode element is coupled to the third contact point 1313*a* of the second portion 1313 of the radiator 131. In other words, as the position of the feeding point 1317 and that of the ground point 1319 are changed in this embodiment, the diode element is arranged in an opposite direction accordingly.

Similarly, the feeding point 1317 of the planar antenna 13 is electrically connected to an RF choke 139, and the RF choke 139 is electrically connected to a DC output terminal of the circuit board 113 to block an RF signal flowing into the DC output terminal. The DC output terminal outputs a DC control signal to control the ON or OFF state of the diode element. On the other hand, the DC blocker 141 is also a capacitor, which is electrically connected between the second contact point 1311*b* of the first portion 1311 and the fourth contact point 1313*b* of the second portion 1313 of the radiator 131 and configured to block the DC control signal flowing into the fourth contact point 1313*b* of the second portion 1313 via the second contact point 1311*b* of the first portion 1311.

According to the above descriptions, the planar antenna of the subject application utilizes the screening element 133 to generate a HF current path and a LF current path in each of the two operating modes respectively and utilizes the switch 135 to flexibly switch between the two operating modes. Thus, the planar antenna can operate at multiple central frequencies to transmit and receive RF signals of different frequency bands or of different communication systems. Further speaking, FIG. 6 and FIG. 7 are schematic views depicting voltage standing wave ratios (VSWRs) when an antenna of the present invention operates within different frequency bands respectively, wherein the antenna has a screening element and a switching element. As shown in FIG. 6, when the switch is turned off, the antenna can operate at central frequencies of 850 MHz and 1775 MHz; and when the switch is turned on, the antenna can operate at central frequencies of 900 MHz and 2035 MHz. Therefore, the antenna covers the frequency bands of GSM850 and GSM900 of the Global System for Mobile Communication (GSM), DCS 1800 of the Digital Communication System (DCS), PCS1900 of the Personal Communications Services (PCS), and the Universal Mobile Telecommunications System (UMTS). Furthermore, as shown in FIG. 7, the antenna can also be applied to the wideband frequency bands (e.g., LTE, GSM, CDMA/WCDMA) required by the 3GPP Long Term Evolution (3GPP LTE) system; in this case, when the switch is turned off, the antenna can operate at central frequencies of 698 MHz and 1775 MHz, and when the switch is turned on, the antenna can operate at central frequencies of 716 MHz and 2035 MHz. As can be seen from this, the planar antenna of the subject application can be applied in various communication systems depending on practical requirements.

Specifically, the subject application can provide a very large operable bandwidth by using only one radiator. Therefore, compared to the conventional antennas having the similar functionalities, the antenna of the subject application can have its volume reduced by about ⅓ and provide a better performance. Furthermore, as the planar antenna of the subject application has only one radiator but no other parasitic antenna elements and/or other branches, it has not only a reduced volume but also a relatively simple design as compared to the conventional multi-frequency planar inverted-F antenna; as a result, the planar antenna can be disposed within the clearance area of the handheld device more effectively to reduce the influence of other electronic parts of the handheld device on the characteristics of the planar antenna. On the other hand, in case that the size of the clearance area is reduced with the size of the planar antenna, the internal spatial arrangement of the handheld device can be made more flexible.

The above disclosure is related to the detailed technical contents and inventive features thereof. People skilled in this field may proceed with a variety of modifications and replacements based on the disclosures and suggestions of the invention as described without departing from the characteristics thereof. Nevertheless, although such modifications and replacements are not fully disclosed in the above descriptions, they have substantially been covered in the following claims as appended.

BRIEF DESCRIPTION OF REFERENCE NUMERALS

Figure 1:
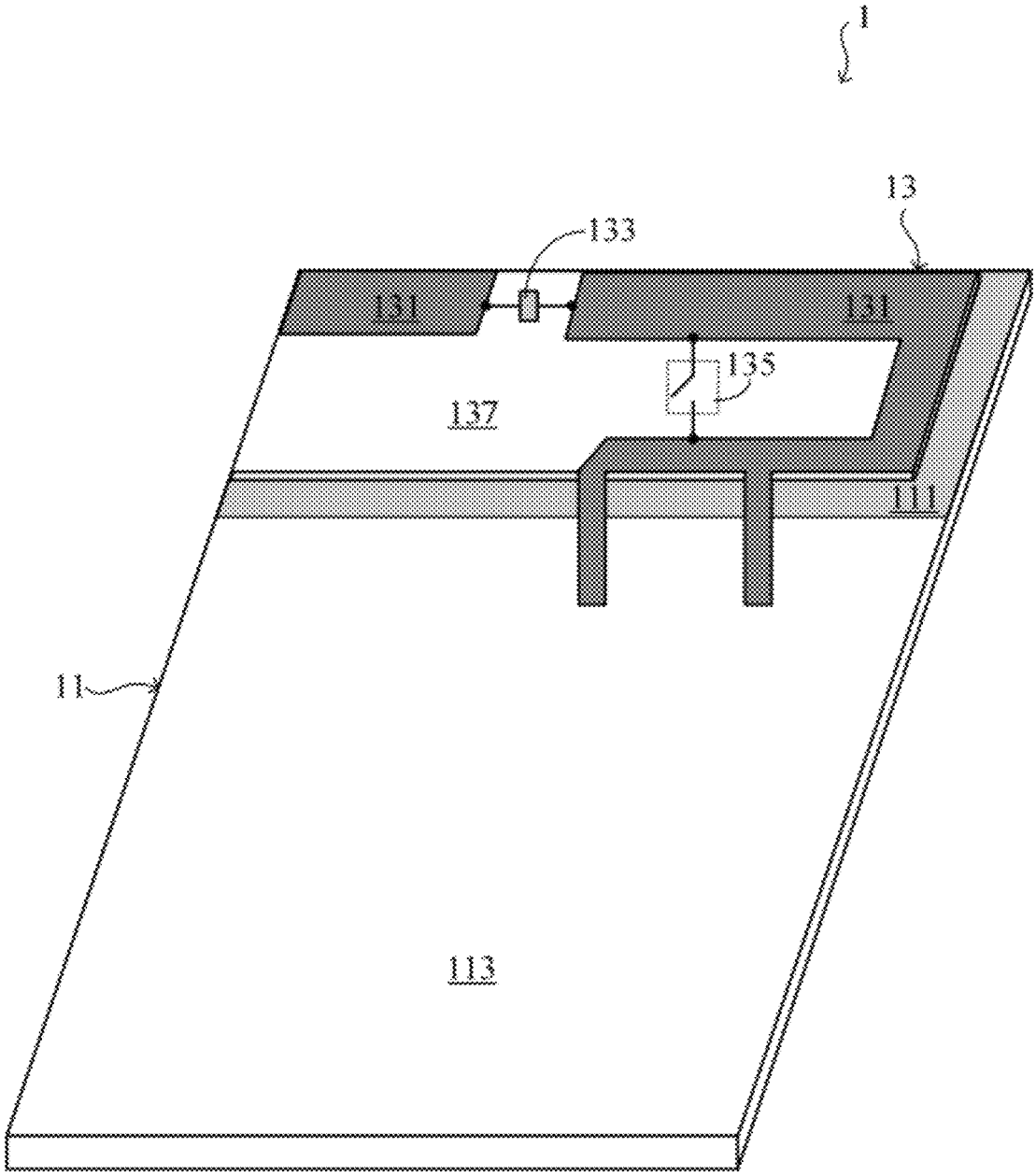
FIG. 1 is a schematic view of a handheld device 1 according to a first embodiment of the present invention.
Figure 2:
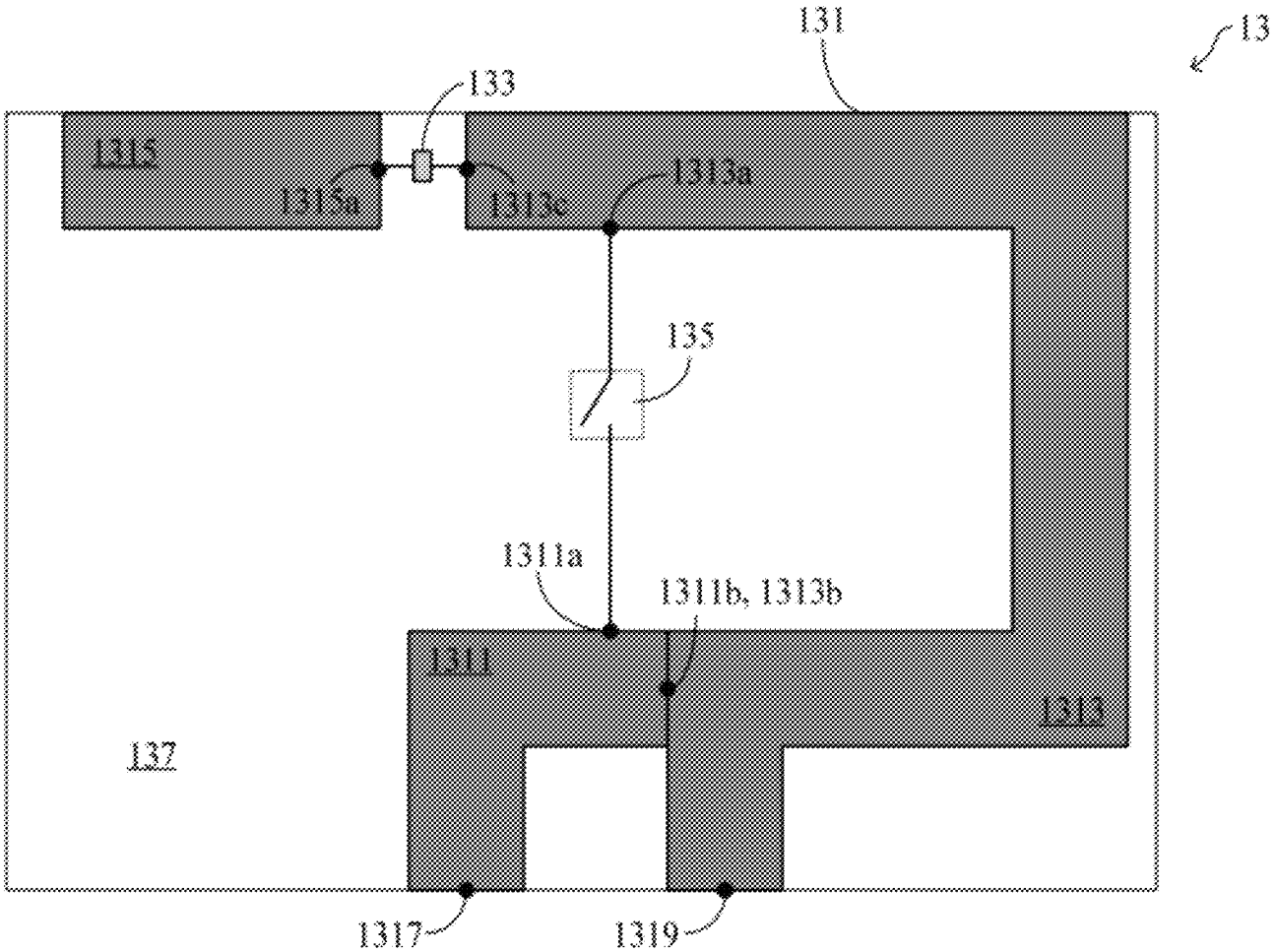
FIG. 2 is a top view of a planar antenna 13 according to the first embodiment of the present invention.
Figure 3:
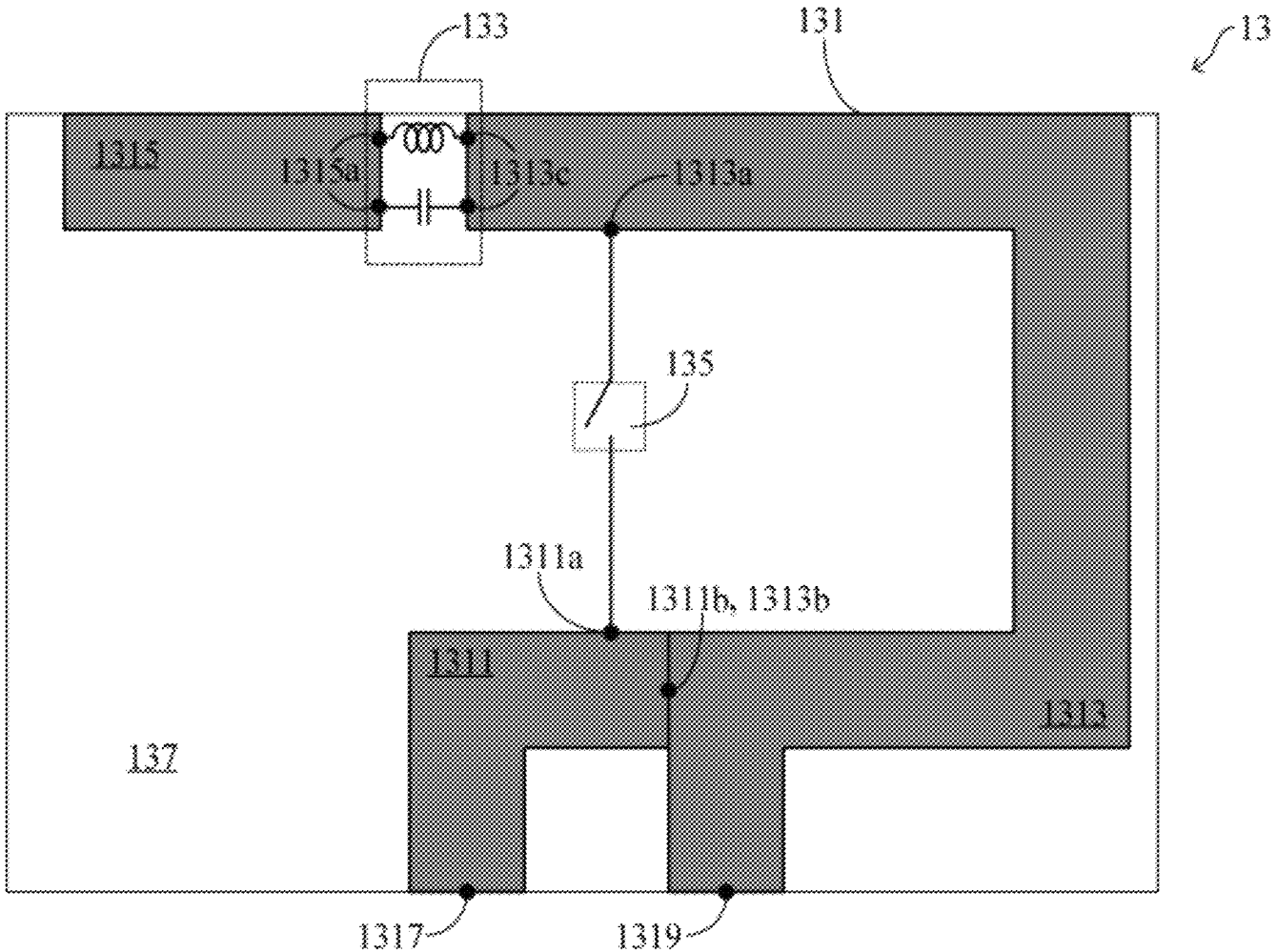
FIG. 3 is a top view of a planar antenna 13 according to a second embodiment of the present invention.
Figure 4:
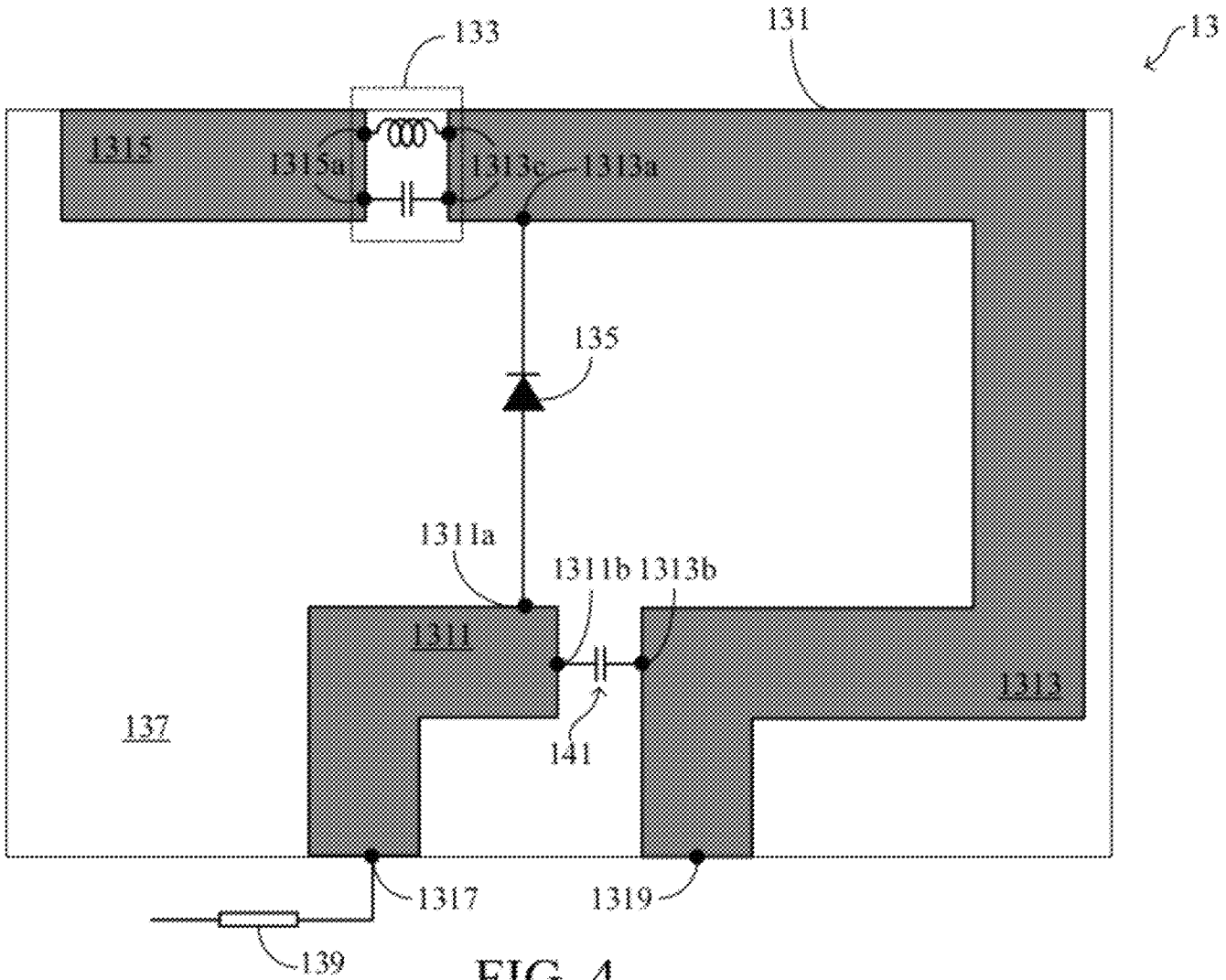
FIG. 4 is a top view of a planar antenna 13 according to a third embodiment of the present invention.
Figure 5:
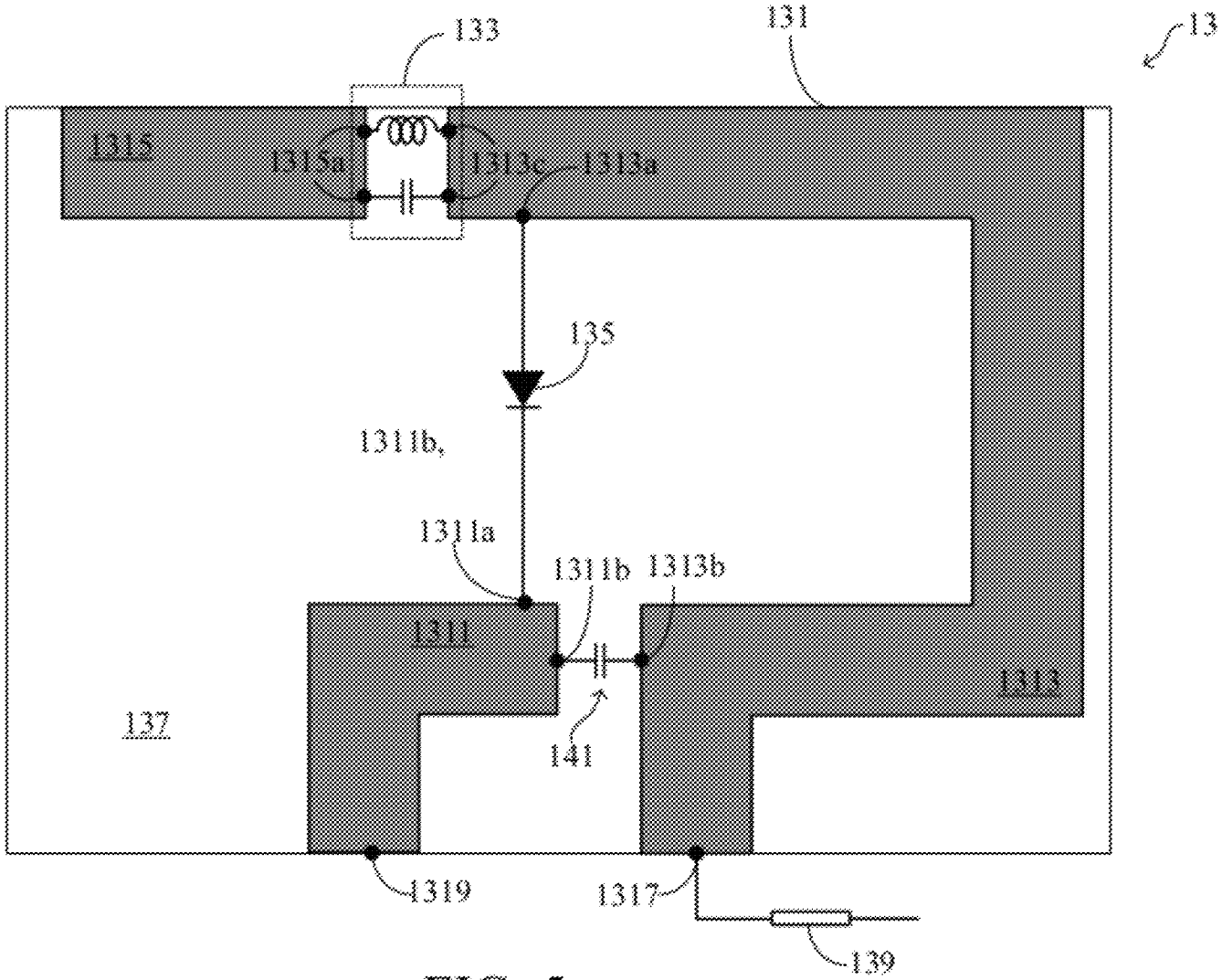
FIG. 5 is a top view of a planar antenna 13 according to a fourth embodiment of the present invention.
Figure 6:
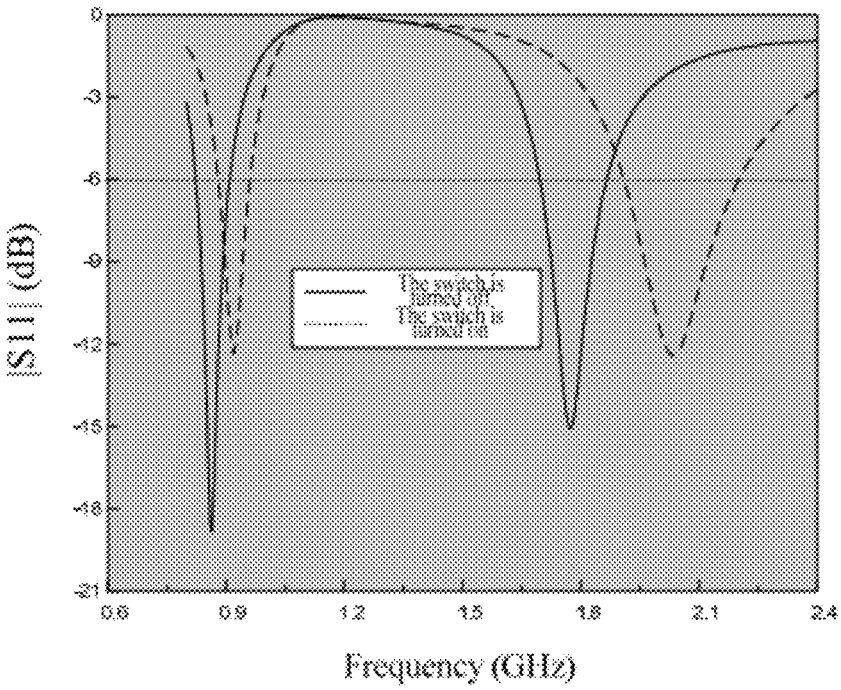
FIGS. 6 and 7 are schematic views of voltage standing wave ratios (VSWRs) when an antenna of the present invention operates within different frequency bands respectively, wherein the antenna has a screening element and a switching element.
Figure 7:
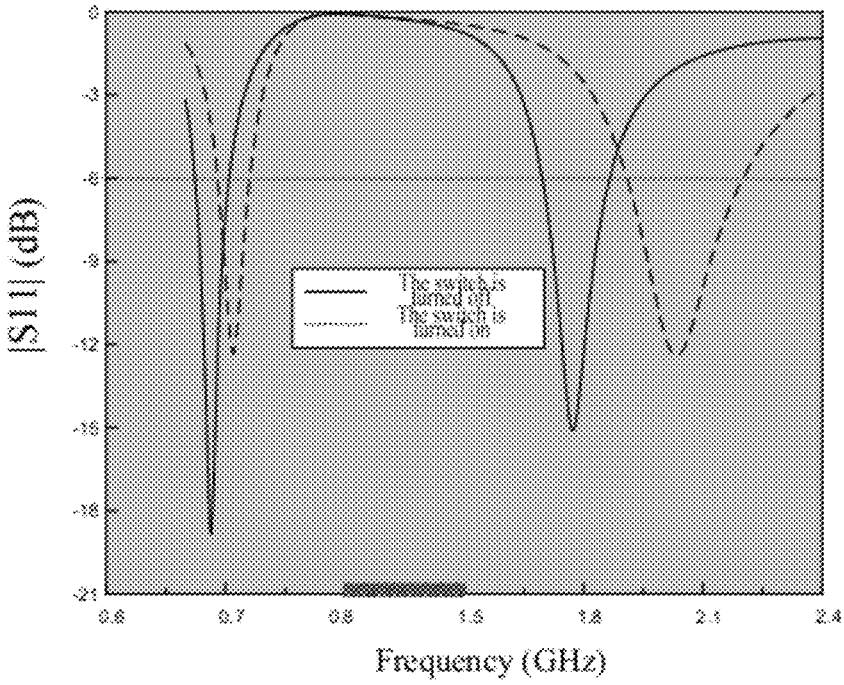

1: handheld device
11: substrate
111: clearance area
113: circuit board
13: planar antenna
131: radiator
1311: first portion of radiator
1311*a*: first contact point
1311*b*: second contact point
1313: second portion of radiator
1313*a*: third contact point
1313*b*: fourth contact point
1313*c*: fifth contact point
1315: third portion of radiator
1315*a*: sixth contact point
1317: feeding point
1319: ground point
133: screening element
135: switch
137: carrier
139: RF blocker
141: DC blocker

What is claimed is:

1. A planar antenna, comprising:

a radiator, comprising:

a first portion comprising a first contact point and a second contact point;

a second portion comprising a third contact point, a fourth contact point electrically connected to the second contact point, and a fifth contact point; and a third portion comprising a sixth contact point;

a screening element, being electrically connected between the fifth contact point and the sixth contact point to make the planar antenna operating in a first high-frequency (HF) current path and a first low-frequency (LF) current path; and a switch, being electrically connected between the first contact point and the third contact point to make the planar antenna operating in a second HF current path and a second LF current path;

wherein when the switch is turned off, the planar antenna operates at a first HF central frequency corresponding to the first HF current path and a first LF central frequency corresponding to the first LF current path at the same time, and when the switch is turned on, the planar antenna operates at a second HF central frequency corresponding to the second HF current path and a second LF central frequency corresponding to the second LF current path at the same time.

2. The planar antenna as claimed in claim 1, wherein the screening element is an elongate transmission line or at least one passive element.

3. The planar antenna as claimed in claim 1, wherein the first portion of the radiator further comprises a feeding point coupled to a circuit board, and the second portion of the radiator further comprises a ground point coupled to a ground terminal of the circuit board.

4. The planar antenna as claimed in claim 3, further comprising:

a radio frequency (RF) choke, being electrically connected between the feeding point of the first portion of the radiator and a direct current (DC) output terminal of the circuit board, and configured to block an RF signal flowing into the DC output terminal, wherein the switch is a diode element and the DC output terminal outputs a DC control signal to control the diode element; and a DC blocker, being electrically connected between the second contact point of the first portion of the radiator and the fourth contact point of the second portion of the radiator, and configured to block the DC control signal flowing into the fourth contact point of the second portion via the second contact point of the first portion.

5. The planar antenna as claimed in claim 1, wherein the first portion of the radiator further comprises a ground point electrically connected to a ground terminal of a circuit board, and the second portion of the radiator further comprises a feeding point electrically connected to the circuit board.

6. The planar antenna as claimed in claim 5, further comprising:

an RF choke, being electrically connected between the feeding point of the second portion of the radiator and a DC output terminal of the circuit board, and configured to block an RF signal flowing into the DC output terminal, wherein the switch is a diode element and the DC output terminal outputs a DC control signal to control the diode element; and a DC blocker, being electrically connected between the second contact point of the first portion of the radiator and the fourth contact point of the second portion of the radiator, and configured to block the DC control signal flowing into the second contact point of the first portion via the fourth contact point of the second portion.

7. A handheld device, comprising:

a substrate including a clearance area; and a planar antenna being disposed within the clearance area, and configured to transmit and receive an RF signal, the planar antenna comprising:

a radiator, comprising:

a first portion comprising a first contact point and a second contact point;

a second portion comprising a third contact point, a fourth contact point electrically connected to the second contact point, and a fifth contact point; and a third portion comprising a sixth contact point;

a screening element, being electrically connected between the fifth contact point and the sixth contact point to make the planar antenna operating at a first HF current path and a first LF current path; and a switch, being electrically connected between the first contact point and the third contact point to make the planar antenna operating at a second HF current path and a second LF current path;

wherein when the switch is turned off, the planar antenna operates at a first HF central frequency corresponding to the first HF current path and a first LF central frequency corresponding to the first LF current path at the same time, and when the switch is turned on, the planar antenna operates at a second HF central frequency corresponding to the second HF current path and a second LF central frequency corresponding to the second LF current path at the same time.

8. The handheld device as claimed in claim 7, wherein the screening element is an elongate transmission line or at least one passive element.

9. The handheld device as claimed in claim 7, wherein the substrate further comprises a circuit board, the first portion of the radiator further comprises a feeding point coupled to the circuit board, and the second portion of the radiator further comprises a ground point coupled to a ground terminal of the circuit board.

10. The handheld device as claimed in claim 9, wherein the planar antenna further comprises:

an RF choke, being electrically connected between the feeding point of the first portion of the radiator and a DC output terminal of the circuit board, and configured to block the RF signal flowing into the DC output terminal, wherein the switch is a diode element and the DC output terminal outputs a DC control signal to control the diode element; and a DC blocker, being electrically connected between the second contact point of the first portion of the radiator and the fourth contact point of the second portion of the radiator, and configured to block the DC control signal flowing into the fourth contact point of the second portion via the second contact point of the first portion.

11. The handheld device as claimed in claim 7, wherein the substrate further comprises a circuit board, the first portion of the radiator further comprises a ground point coupled to a ground terminal of the circuit board, and the second portion of the radiator further comprises a feeding point coupled to the circuit board.

12. The handheld device as claimed in claim 11, wherein the planar antenna further comprises:

an RF choke, being electrically connected between the feeding point of the second portion of the radiator and a DC output terminal of the circuit board, and configured to block the RF signal flowing into the DC output terminal, wherein the switch is a diode element and the DC output terminal outputs a DC control signal to control the diode element; and a DC blocker, being electrically connected between the second contact point of the first portion of the radiator and the fourth contact point of the second portion of the radiator, and configured to block the DC control signal flowing into the second contact point of the first portion via the fourth contact point of the second portion.

* * * * *